US006122849A

United States Patent [19]

Kida et al.

[11] Patent Number: 6,122,849

[45] Date of Patent: Sep. 26, 2000

[54] IRON WITH THERMAL RESISTANCE LAYER

[75] Inventors: Kenji Kida; Shinichi Nakajima, both of Osaka; Toshihide Nakamura, Hyogo; Shinichiro Kobayashi, Osaka, all of Japan

[73] Assignee: Matsushita Electric Industrial Co., Ltd., Osaka, Japan

[21] Appl. No.: 09/300,409

[22] Filed: Apr. 27, 1999

[30] Foreign Application Priority Data

| | | | |
|---|---|---|---|
| Apr. 28, 1998 | [JP] | Japan | 10-118356 |
| Mar. 11, 1999 | [JP] | Japan | 11-064479 |

[51] Int. Cl.[7] ..... D06F 75/38; D06F 75/24

[52] U.S. Cl. ..... 38/93

[58] Field of Search ..... 38/93, 77.7, 77.83, 38/80, 81, 88, 89

[56] References Cited

U.S. PATENT DOCUMENTS

| | | | |
|---|---|---|---|
| 2,309,179 | 1/1943 | Ferris | 38/93 X |
| 2,612,587 | 9/1952 | Guerra | 38/81 |
| 2,763,946 | 9/1956 | D'Alessandro | 38/77.7 |
| 2,820,877 | 1/1958 | Oates, Jr. . | |
| 4,430,553 | 2/1984 | Antimovski | 38/88 |
| 5,025,578 | 6/1991 | Firatli et al. | 38/93 |
| 5,042,179 | 8/1991 | van der Meer . | |
| 5,074,066 | 12/1991 | Sakano et al. . | |
| 5,117,092 | 5/1992 | Shimizu et al. . | |
| 5,120,934 | 6/1992 | Nakada et al. . | |
| 5,146,700 | 9/1992 | Prosser | 38/93 |

FOREIGN PATENT DOCUMENTS

| | | | |
|---|---|---|---|
| 3644211 | 8/1987 | Germany | 38/93 |
| 490441 | 11/1936 | United Kingdom | 38/89 |

*Primary Examiner*—Ismael Izaguirre
*Attorney, Agent, or Firm*—Wenderoth, Lind & Ponack, L.L.P.

[57] ABSTRACT

An iron has a first base to be directly heated for increasing an amount of accumulated heat, a second base including a soleplate and a thermal resistance layer disposed between the bases. The thermal resistance layer has a greater heat resistance than the first base so that the first base heated by a heater can maintain a higher temperature than the second base. The iron of the present invention can increase an amount of accumulated heat, thereby extending not only an ironing period but also a period for spraying steam. If a weight of the iron is decreased, the iron still can hold approximately the same accumulated heat as a conventional iron so that a lightweight iron can be provided.

31 Claims, 15 Drawing Sheets

IRON WITH THERMAL RESISTANCE LAYER

FIELD OF THE INVENTION

The present invention relates to an iron for smoothing wrinkles of clothes.

BACKGROUND OF THE INVENTION

Users of irons have demanded that irons, first, deal with a bulk of clothes at one time and, second, be lightweight for ease of ironing. The U.S. Pat. No. 5,042,179 discloses an iron having two large heaters for controlling steam production depending on ironing cycles, which intends to meet the first demand of the users. The disclosed iron can thus supply steam appropriately to respective ironing cycles, and also deal with a bulk of clothes at one time.

However, the disclosed iron has a pressurizing steam generator for supplying steam smoothly, so that the iron is heavy. This iron thus places a heavy load on the users. Further, since this iron requires a large amount of heat, the iron must always be powered, and this model is thus far from being a cordless type iron. In these years, cordless irons have become widely used because they can make ironing easier. A cordless iron must accumulate a large amount of heat therein and be lightweight at the same time. The iron disclosed by the U.S. Pat. No. 5,042,179 has some heat accumulation effect because steam is stored by pressurizing; however, this structure results in a heavy body.

A conventional cordless iron is described hereinafter with reference to FIG. 17. The iron 1 comprises (a) a base 3 including a vaporizing chamber 2, (b) a heater 4 for heating the base 3, (c) a water tank 5 disposed above base 3 for pooling water, and (d) a valve 7 for opening/closing a channel for supplying the water in tank 5 to a watercourse 6.

Valve 7 comprises the following elements:

- a steam button 8 mounted above water tank 5 so that the button 8 can move up and down (i.e., such that one push moves the button down, and another push moves the button up);
- an open/close pole 9 which travels up and down together with the steam button 8 and which has a latch function; and
- a spring 10 for urging both pole 9 and button 8 in the upward direction.

A lower end of pole 9 forms a hemisphere and engages in an upper end of watercourse 6 so that the lower end of pole 9 can block water from flowing into the watercourse 6 from the water tank 5.

The watercourse 6 is disposed above vaporizing chamber 2, and the water in water tank 5 is dripped into vaporizing chamber 2 through a drip hole 11. The soleplate of base 3 is provided with steam vents 12 from which the steam from vaporizing chamber 2 spouts.

A thermistor type temperature sensor 13 for sensing a temperature of base 3 is placed on base 3. This temperature sensor 13 and a control circuit 14 control the heating of heater 4, so that the iron is controlled to maintain an appropriate temperature.

An operation of the structure discussed above is described hereinafter. First, a user turns on a switch to provide power to heater 4. The heat of heater 4 transfers to base 3 and heats base 3. After that, temperature sensor 13 senses that base 3 is heated up to a given temperature, and then control circuit 14 cuts off the heating of heater 4.

Since base 3 dissipates some heat, the temperature of the iron lowers after a while whether the user operates the iron or leaves it. Temperature sensor 13 senses the lowered temperature, and again supplies power to heater 4 to start heating. The range of temperature fall is predetermined, and a range of ca. 10° C. is generally employed.

An operation of using the steam is described hereinafter. When the iron is heated up to the given temperature, the user pushes steam button 8 against spring 10, which releases a latch mechanism and moves pole 9 upward, and watercourse 6 is then opened. The water in tank 5 drips into vaporizing chamber 2 through drip hole 11 due to gravity. The dripped water dissipates the heat from base 3 and vaporizes into steam, then spouts from steam vents 12.

In this conventional structure, however, the base temperature lowers so soon that it is hard to smooth wrinkles of a bulk of clothes, particularly in the case of a cordless iron. This structure also sustains a spray of steam for only a short period. Therefore, when a bulk of clothes must be ironed, or a so called power-shot demanding a lot of steam is required, the base temperature lowers so soon that the user must halt the ironing to allow the heater to heat up again. This lowers the operational efficiency.

In the cordless iron, the sustainable period of spraying steam is determined by an amount of heat accumulated. In other words, the accumulated heat amount Q depends on a specific heat "c", a mass "W", and a temperature "T" of the base; $Q=cWT$.

The accumulated heat amount increases at the greater values of these three factors. Regarding the specific heat "c", no practical material featuring a lightweight and a higher specific heat can replace aluminum, which is presently employed as a base material.

Regarding the mass "W", there is some limit to increasing the mass (weight) of the base, because the users must hold the iron during the operation. It is thus impractical to increase the weight of the iron. In general, the iron weighs 1.1 kg including 600 g of the base. This is the upper limit to practical use.

Regarding the temperature "T", since the base 3 and the soleplate are unitarily formed, the temperature of base 3 must be adjusted to be appropriate for respective materials of clothes. The temperature of base 3 cannot be further raised from the present condition, in order to protect the clothes. The "high mode" of the present model is ca. 220° C., and this is the upper limit.

Another conventional type of iron is shown in FIG. 18, where an upper base 15 and a lower base 16 are used instead of the base 3; however, the heat from the upper base 15 instantly transfers to the lower base 16, and this structure thus produces the same effect as the base 3 unitarily formed with the soleplate.

SUMMARY OF THE INVENTION

The present invention addresses the problems discussed above and aims to provide an iron for which the base can accumulate greater heat amount Q and its temperature won't lower so easily while a soleplate can maintain a temperature, and for which a sustainable period of steam spraying is extended.

A base of an iron of the present invention comprises the following elements:

(a) a first base to be directly heated;

(b) a second base including a soleplate; and (c) a thermal resistance layer between the first and second bases.

The heat-resistance rate of the thermal resistance layer is set at a greater value than that of the first base, so that the temperature of the first base heated by a heater becomes higher than that of the second base. As a result, the total accumulated heat amount of the iron can be increased.

The thermal resistance layer comprises at least one of metal, resin, filling agent, mineral, or air. The thermal resistance layer can also be formed by shaping a surface of either one of the first or second base into a specific pattern.

DETAILED DESCRIPTION OF THE EXEMPLARY EMBODIMENTS

Exemplary embodiments of the present invention are described with reference to the accompanying drawings. The same elements as the conventional iron are denoted with the same reference numbers and the descriptions thereof are omitted here.

First exemplary embodiment

A first exemplary embodiment of the present invention is described with reference to FIG. 1 through FIG. 7.

Figure 1:
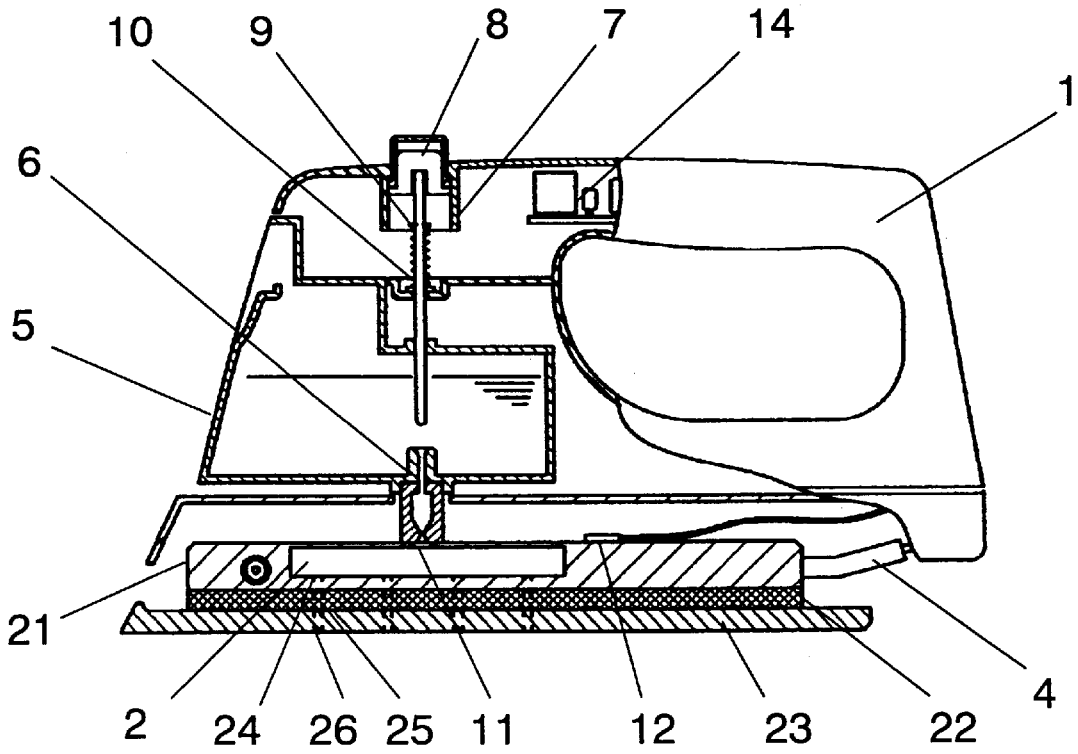
FIG. 1 is a side cross section of part of an iron in accordance with a first exemplary embodiment of the present invention.

In FIG. 1, a first base 21 is made of aluminum and includes a vaporizing chamber 2 and a heater 4. A thermal resistance layer 22 is disposed underneath first base 21, and has heat conductivity. A second base 23 is made of aluminum and disposed underneath thermal resistance layer 22, and functions as a soleplate. Thermal resistance layer 22 has a lower heat conduction rate than that of second base 23, and is made of silicone rubber which is heat-resistive.

Figure 2:
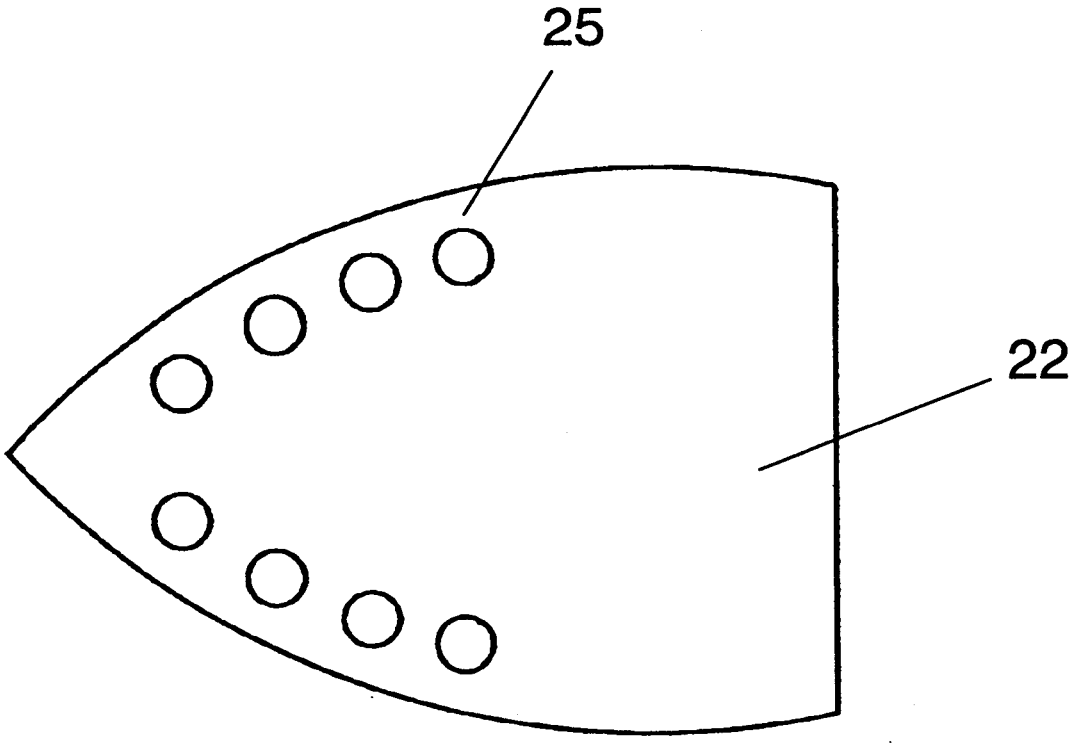
FIG. 2 is a plan view of a thermal resistance layer in accordance with the first exemplary embodiment of the present invention.
Figure 3:
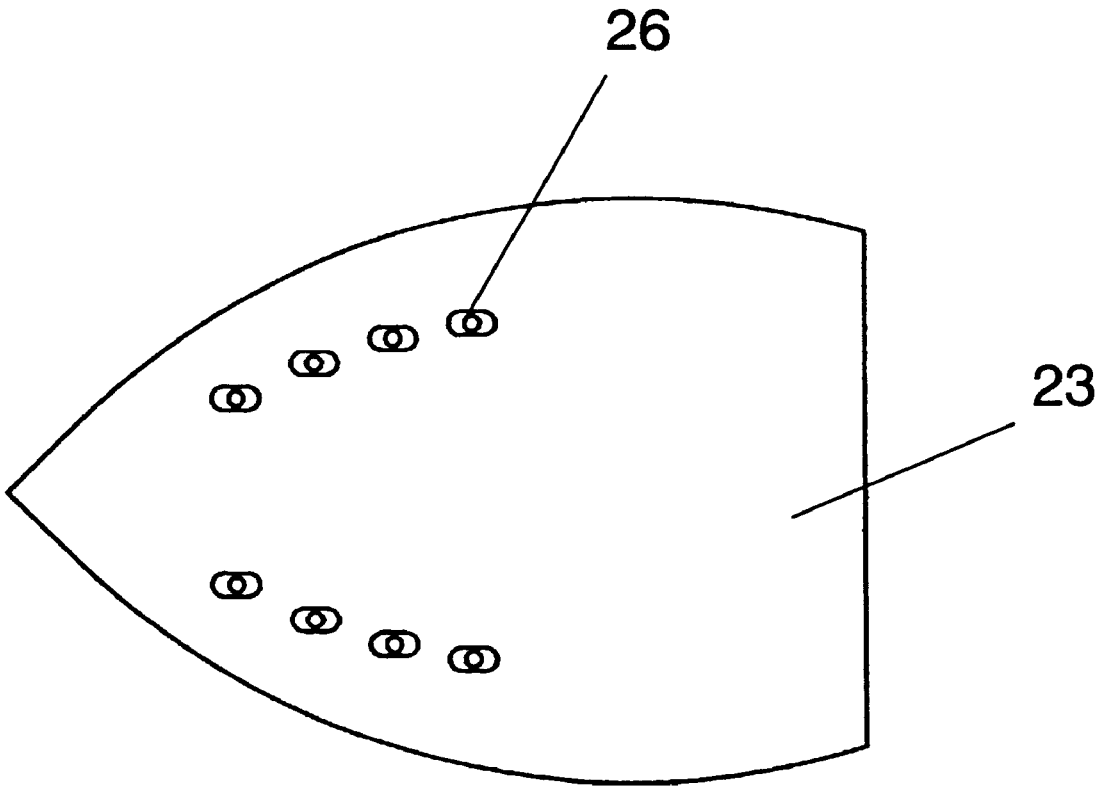
FIG. 3 is a bottom view of a second base in accordance with the first exemplary embodiment of the present invention.

First steam passages 24 are disposed underneath vaporizing chamber 2, and second steam passages 25 extend through thermal resistance layer 22 which is placed just underneath first base 21. FIG. 2 illustrates a plan view of thermal resistance layer 22. As FIG. 3 shows, steam vents 26 of second base 23 are formed just under first and second steam passages 24 and 25.

An operation of the structure discussed above is described hereinafter. First, a switch of control circuit 14 is turned on to supply power to heater 4; this is the same process as the conventional iron. The heating of heater 4 directly heats up first base 21. Since thermal resistance layer 22 is in contact with first base 21, and second base 23 is in contact with thermal resistance layer 22, the heat of first base 21 transfers to second base 23 via thermal resistance layer 22, so that second base 23 is also heated. After a while, a temperature sensor 12 senses that first base 21 has reached a given temperature, and then a control circuit 14 cuts off the heating by heater 4. When the temperature of first base 21 lowers, sensor 12 causes heater 4 to start generating heat. As such, the temperature is adjusted within a certain range.

Figure 4:
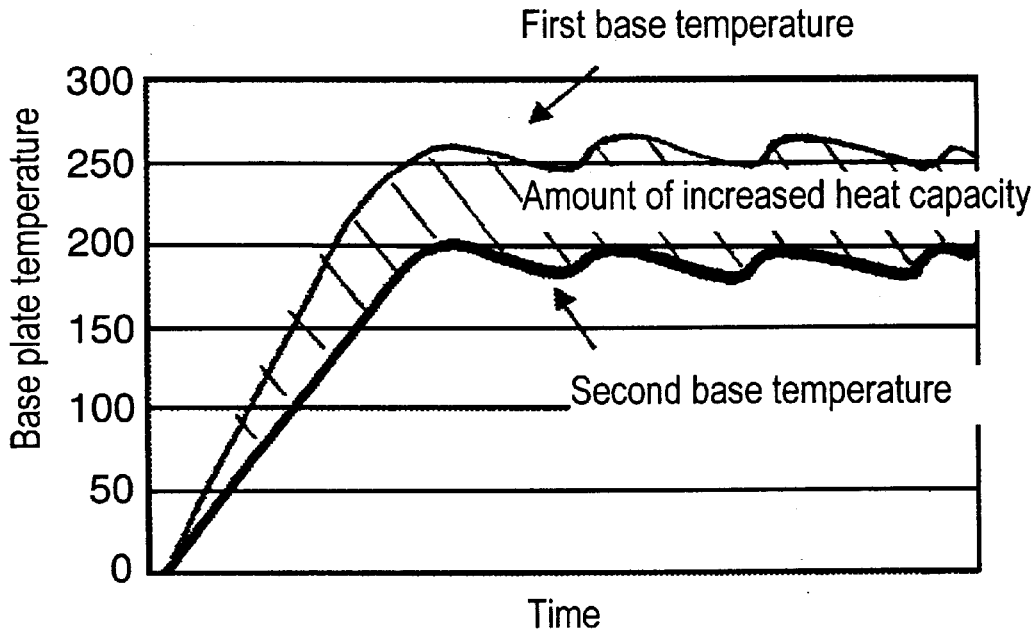
FIG. 4 illustrates the temperature rise of the iron being heated in accordance with the first exemplary embodiment of the present invention.
Figure 5:
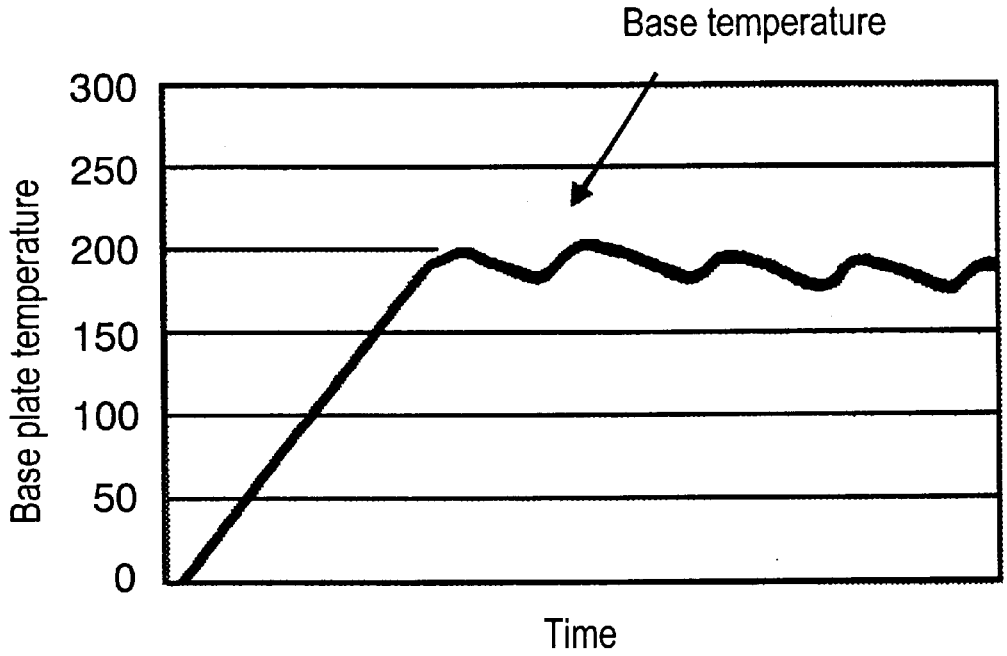
FIG. 5 illustrates a temperature rise of a conventional iron being heated.

FIG. 4 illustrates a relation between a temperature and a time from power-on at a "high temperature mode" until temperature adjustment starts. FIG. 5 illustrates, for the purpose of comparison, the same relation of a conventional iron at a "high-temperature mode" with a base of the same weight.

As FIG. 4 illustrates, a certain temperature difference is found between the first base which is directly heated by heater 4 and the second base which dissipates heat from the soleplate. In this exemplary embodiment, the first base is adjusted at 250° C., and the second base is adjusted at 200° C. which is the "high mode". This balanced condition between the two bases is produced by the presence of thermal resistance layer 22, which has a lower heat conductivity than the two bases, between the two bases. The first base is a heat supplier and the second base is a heat radiator.

The materials of the thermal resistance layer in accordance with the first exemplary embodiment may be metal, resin, filling agent, mineral or the like, so long as they have a greater heat resistance than the material of the first base. Since mica, one of layered minerals, is layered, it can be used as it is, or it can be laid on top of another to form multiple layers so that a greater heat resistance can be provided.

FIG. 5 illustrates that the conventional iron having no thermal resistance layer 22 has approximately the same temperature on the base heated by heater 4 and on the soleplate, i.e. 200° C. at "high mode".

In other words, according to the present invention the soleplate radiates the heat of an appropriate temperature (200° C.) to clothes, while the base can keep the higher temperature. This structure allows the iron to accumulate a greater heat amount shown in a shaded portion of FIG. 5 than the conventional iron. The present invention thus increases the amount of accumulated heat without increasing the weight of the iron per se. As a result, the iron of the present invention can smooth wrinkles of a bulk of clothes because the soleplate incurs only a little temperature fall. Further, this iron is free from being powered during ironing. The iron thus can make the ironing job easier and is easy to handle.

Production of steam in accordance with the first exemplary embodiment is described hereinafter. When a user depresses a steam button 8 against a spring 10 to release the latch mechanism, an open/close pole 9 rises to open a watercourse 6. The water in a tank 5 drips into vaporizing chamber 2 via a drip hole 11. The dripped water deprives base 3 of heat and vaporizes into steam. The steam spouts out from steam vents 26 via steam passages 24 disposed in base 21 and steam passages 25 disposed in thermal resistance layer 22.

Figure 6:
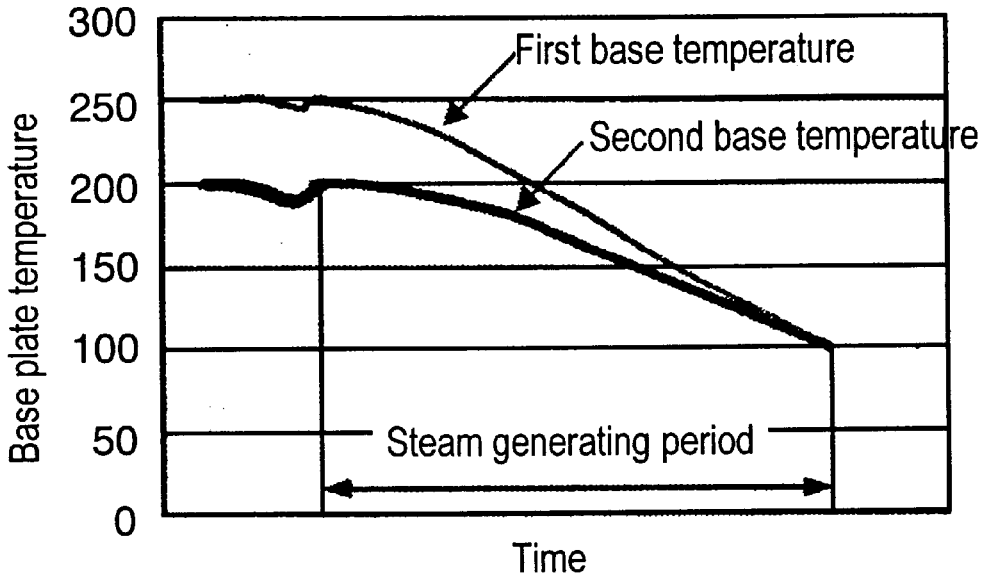
FIG. 6 illustrates temperature fall of the iron of the present invention.
Figure 7:
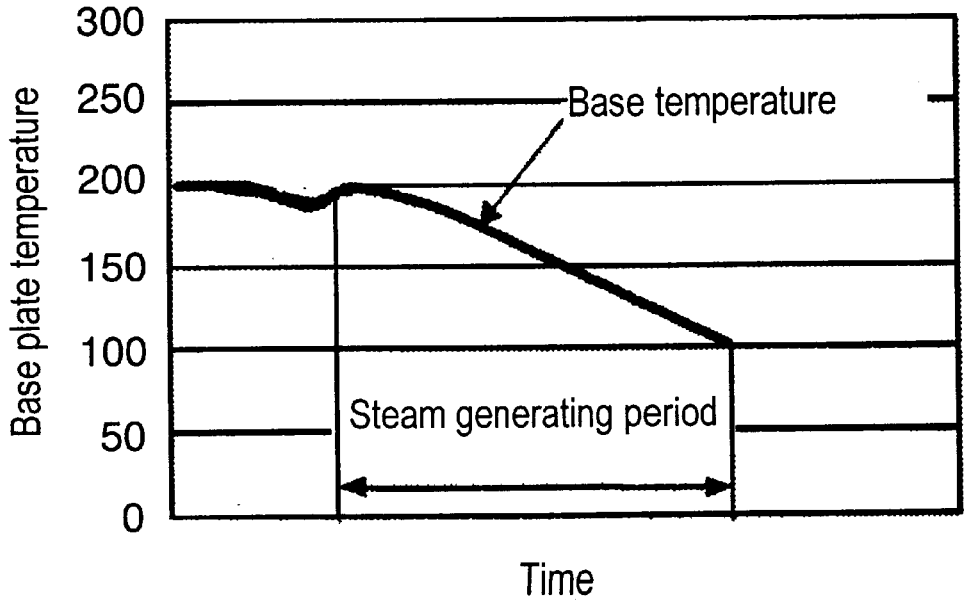
FIG. 7 illustrates temperature fall of the conventional iron being used.

FIG. 6 is a graph illustrating temperature fall of the bases. For the purpose of comparison, FIG. 7 shows the temperature fall of the base when the conventional iron with the base having the same weight spouts out the same amount of steam. As previously discussed, in this exemplary embodiment, the amount of accumulated heat is increased, so that the first base which can maintain a higher temperature can supply heat to the soleplate which incurs temperature fall. Therefore, this exemplary embodiment shows a moderate temperature fall compared with the conventional case. In other words, this embodiment proves that the iron of the present invention can sustain a spray of steam for a longer period than the conventional iron.

In this embodiment, it is desirable that the weight ratio of the first base vs. the total iron is as high as possible to realize more effective heat accumulation.

In this embodiment, a cordless iron is described as an example; however, an iron with a power cord can also produce the same effect, particularly when a bulk of clothes are ironed or power shots demanding a lot of steam are required.

In this embodiment, the conventional iron with the base having the same weight is compared. This comparison shows that the iron of the present invention can be lightened by an amount of weight corresponding to the increased amount of accumulated heat. A lighter iron with the same amount of accumulated heat as the conventional iron thus can be also realized, which can make the ironing job easier.

Second exemplary embodiment

The second exemplary embodiment of the present invention is described hereinafter with reference to FIG. 8 and FIG. 9. Basically the same structure as the first embodiment is used, and therefore, the same reference numbers are used and the descriptions of the same elements are omitted.

Figure 8:
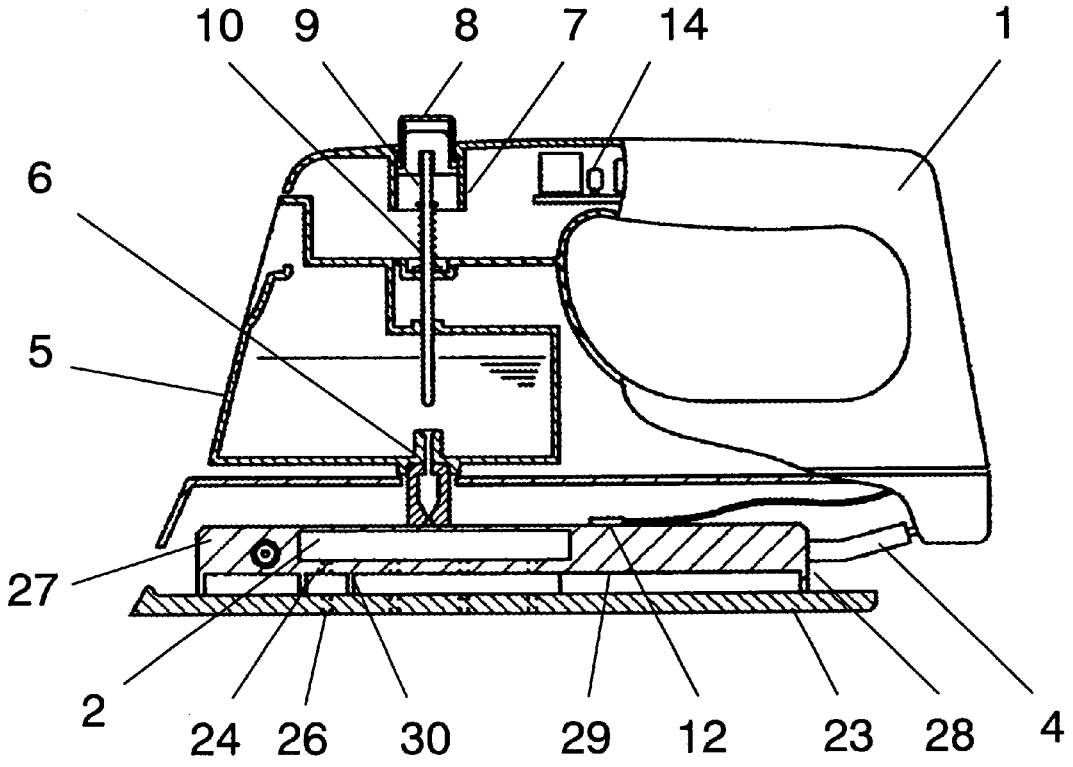
FIG. 8 is a side cross section of part of an iron in accordance with a second exemplary embodiment of the present invention.
Figure 9:
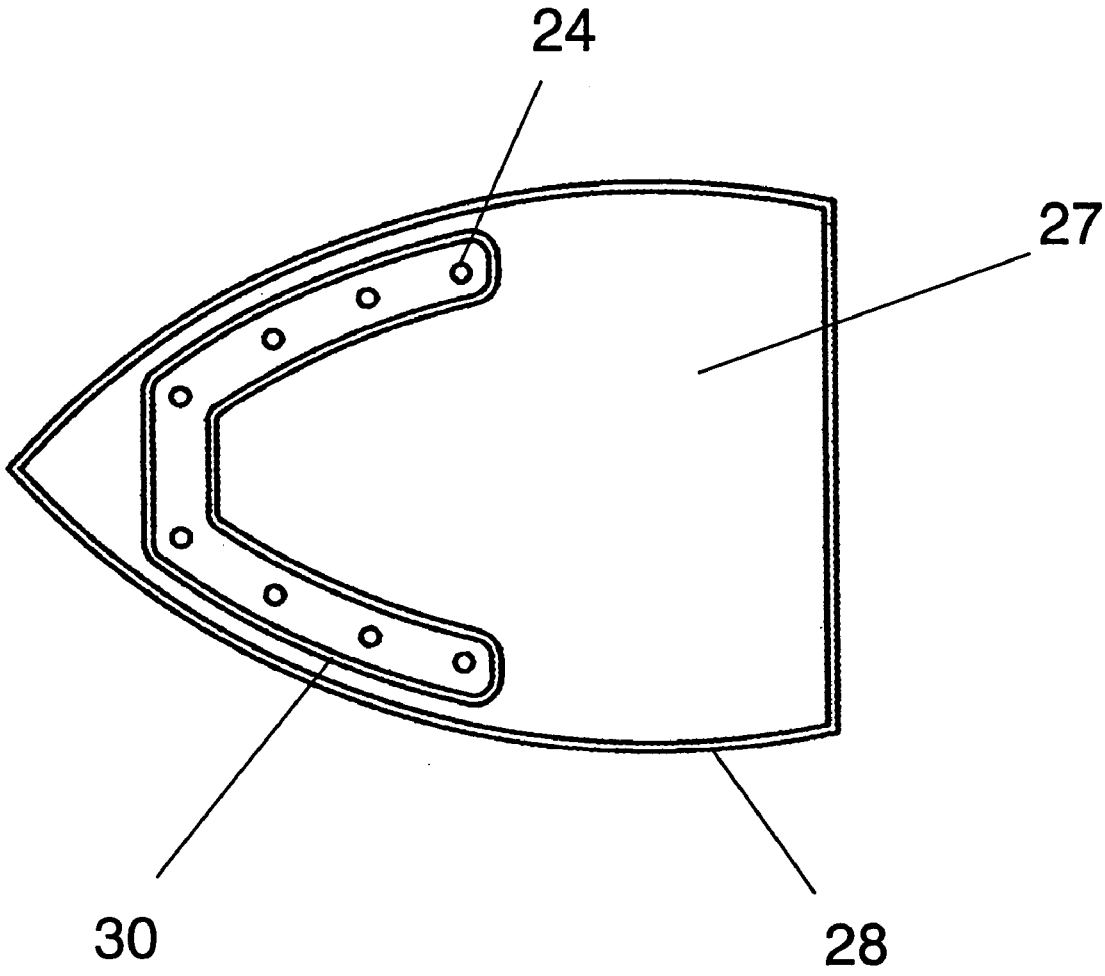
FIG. 9 is a bottom view of a first base in accordance with the second exemplary embodiment of the present invention.

In FIG. 8, first base 27, including vaporizing chamber 2 and heater 4, is made of aluminum. FIG. 9 is a bottom view of first base 27 viewed from below. In the second embodiment, an outer circumferential rib 28 disposed on a lower face of first base 27 directly keeps contact with second base 23. Thermal resistance layer 29 comprises an air layer enclosed by rib 28, the lower face of first base 27 and an upper face of second base 23. The air layer enclosed by the above elements forms a nearly airtight room. A steam rib 30 surrounding first steam passages 24 forms a path leading the steam produced in vaporizing chamber 2 to steam vents 26 provided on second base 23 from steam passages 24 provided on first base 27.

An operation of the iron having the construction discussed above is described hereinafter. In the same manner as with the first exemplary embodiment, the heating of heater 4 heats up first base 27. However, the heat of base 27 won't transfer so easily because thermal resistance layer 29 is disposed underneath the lower face of first base 27, and comprises the air layer which has a lower heat conductivity than second base 23. The heat transfers to second base 23 via outer circumferential rib 28. This structure allows first base 27 to maintain a higher temperature than second base 23, thereby increasing an amount of accumulated heat. As a result, the iron of the present invention can smooth wrinkles of a bulk of clothes because the soleplate incurs only a little temperature fall. Further, this iron is free from being powered during ironing. The iron thus can make the ironing job easier and is easy to handle.

Further, the air layer actually weighs nothing, so that the weight of the first base can be increased by the weight of silicone rubber used in the first embodiment. This results in further increasing the amount of accumulated heat. Since the air layer costs nothing, this embodiment adds another advantage to the first embodiment.

Since the outer circumferential rib 28 effects a semi-airtight room for thermal resistance layer 29, little air leakage is expected and heat conductivity is restrained at a low level. Rib 28 also restrains air convection, which contributes to maintaining heat conductivity at a constant level. As a result, stable heat transfer to the second base can be expected.

The temperature of second base 23, in general, starts lowering from the outer periphery; however, since outer circumference rib 28 supplies heat from the outer periphery, the temperature is distributed on the soleplate more uniformly. This structure allows the iron to be free from problems such as scorching the clothes and poorly smoothing wrinkles of clothes. The iron of the present invention can thus make the ironing job easier and is easy to handle.

Third exemplary embodiment

The third exemplary embodiment is described with reference to FIG. 10 and FIG. 11. Basically the same structure as the second embodiment is used, and therefore, the same reference numbers are used and the descriptions of the same elements are omitted.

Figure 10:
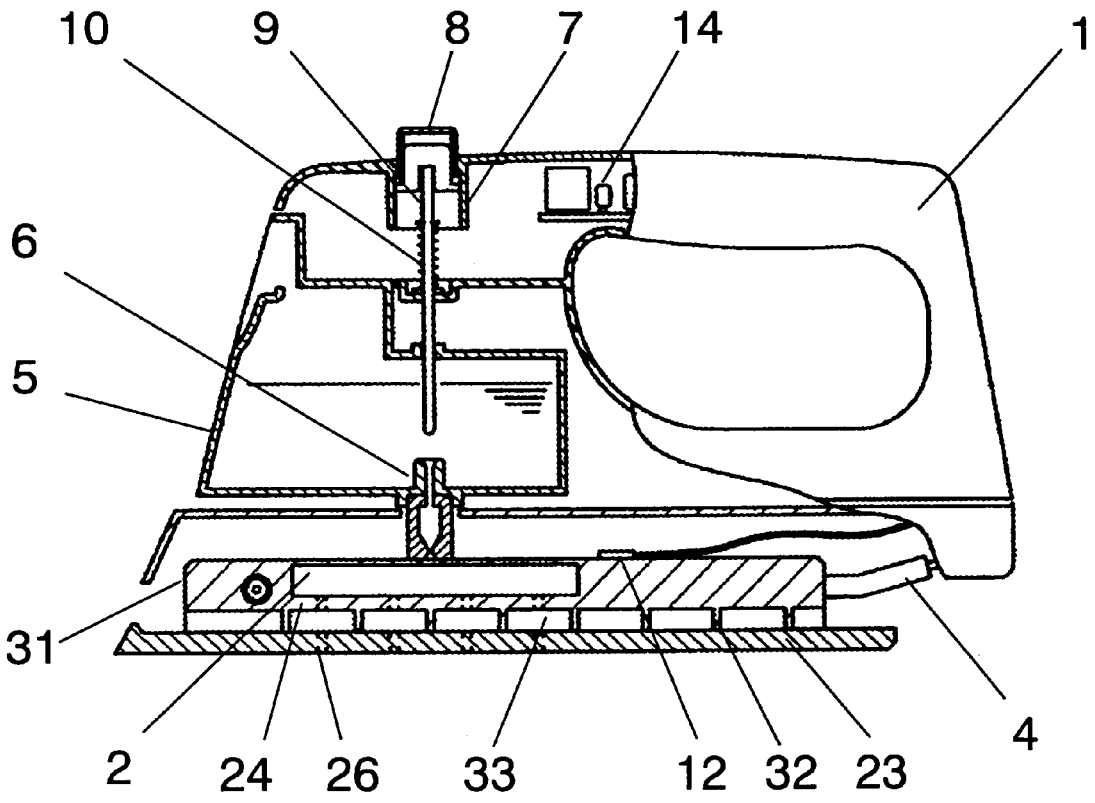
FIG. 10 is a side cross section of part of an iron in accordance with a third exemplary embodiment of the present invention.
Figure 11:
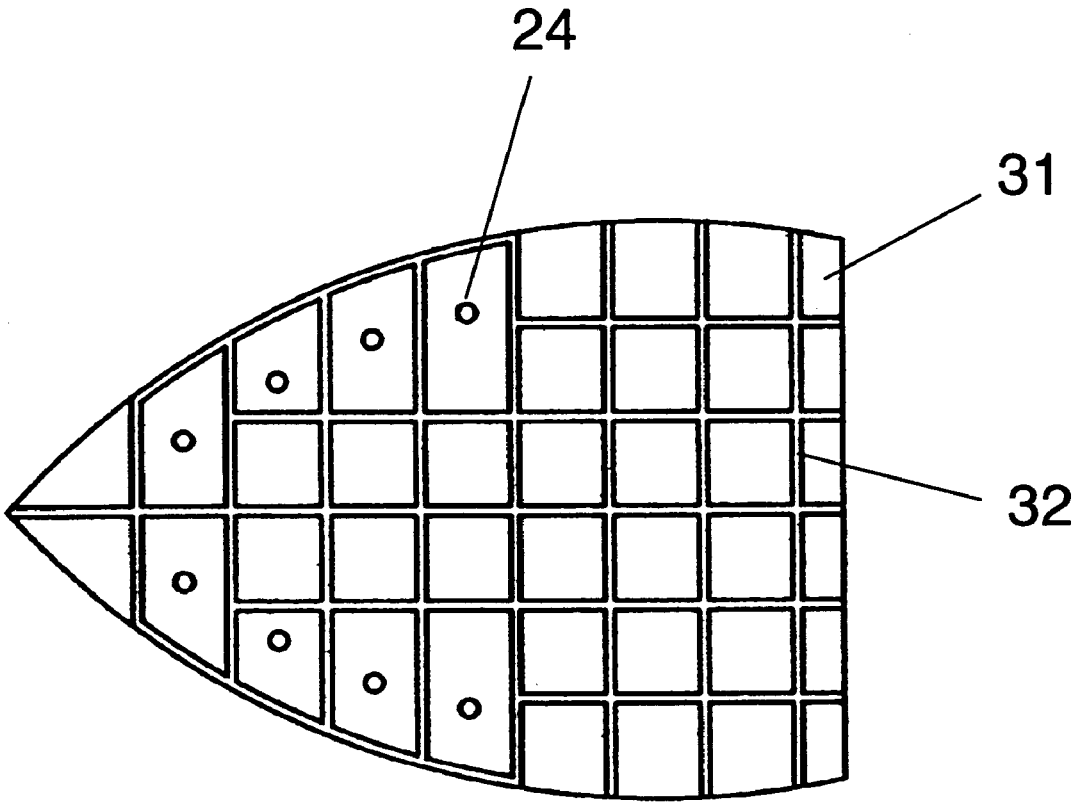
FIG. 11 a bottom view of a first base in accordance with the third exemplary embodiment of the present invention.

In FIG. 10, a first base 31, including vaporizing chamber 2 and heater 4, is made of aluminum. FIG. 11 is a bottom view of first base 31 viewed from below. On an entire lower face of first base 31, a plurality of line-ribs 32 are formed lengthwise and crosswise. Line-ribs 32 directly contact with second base 23. Thermal resistance layer 33 comprises a plurality of air layers enclosed by the lower face of first base 31, line-ribs 32 and an upper face of first base 23. The air layers form independent, nearly airtight rooms.

An operation of the iron having the structure discussed above is described. In the same manner as with the second embodiment, the first base 31 can maintain a higher temperature than second base 23, so that an amount of accumulated heat can be increased. Since thermal resistance layer 33 forms a plurality of small semi-airtight rooms, air convection is further restrained compared to the second embodiment. This contributes to maintaining the heat conductivity at a constant level more strictly. As a result, heat can transfer in a more stable manner to second base 23. The line-ribs provided lengthwise and crosswise can transfer the heat quickly to second base 23 from first base 31 when base 31 incurs temperature fall. In other words, this third embodiment effects quick temperature recovery, and can provide an iron which is easy to operate.

In this description, the line-ribs are described as an example; however, the ribs are not limited to straight line ribs, but may be shaped as waves, arcs and other arbitrary line-patterns in accordance with the shapes of the first and second bases. Contact gaps between the first and second bases can be sealed with some sealing agent, thereby causing the heat to transfer in a more stable manner.

Fourth exemplary embodiment

The fourth exemplary embodiment of the present invention is described with reference to FIG. 12 and FIG. 13. Basically the same structure as the second embodiment is used, and therefore, the same reference numbers are used and the descriptions of the same elements are omitted.

Figure 12:
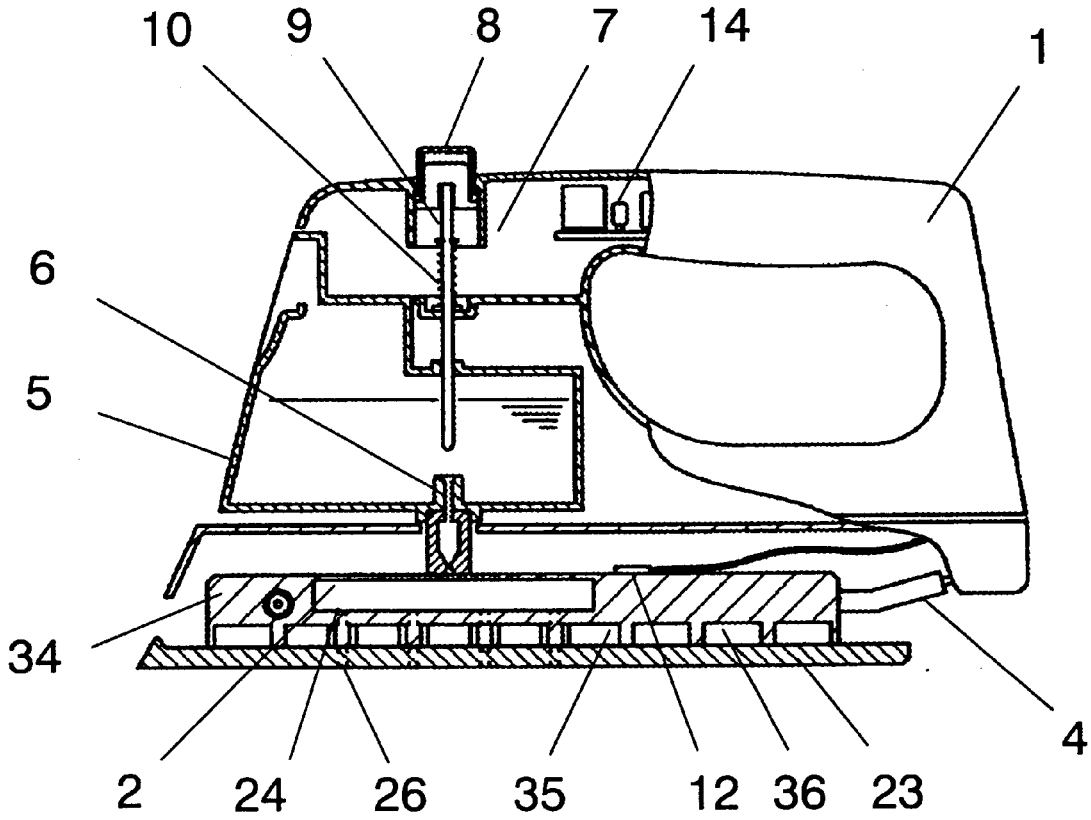
FIG. 12 is a side cross section of part of an iron in accordance with a fourth exemplary embodiment of the present invention.
Figure 13:
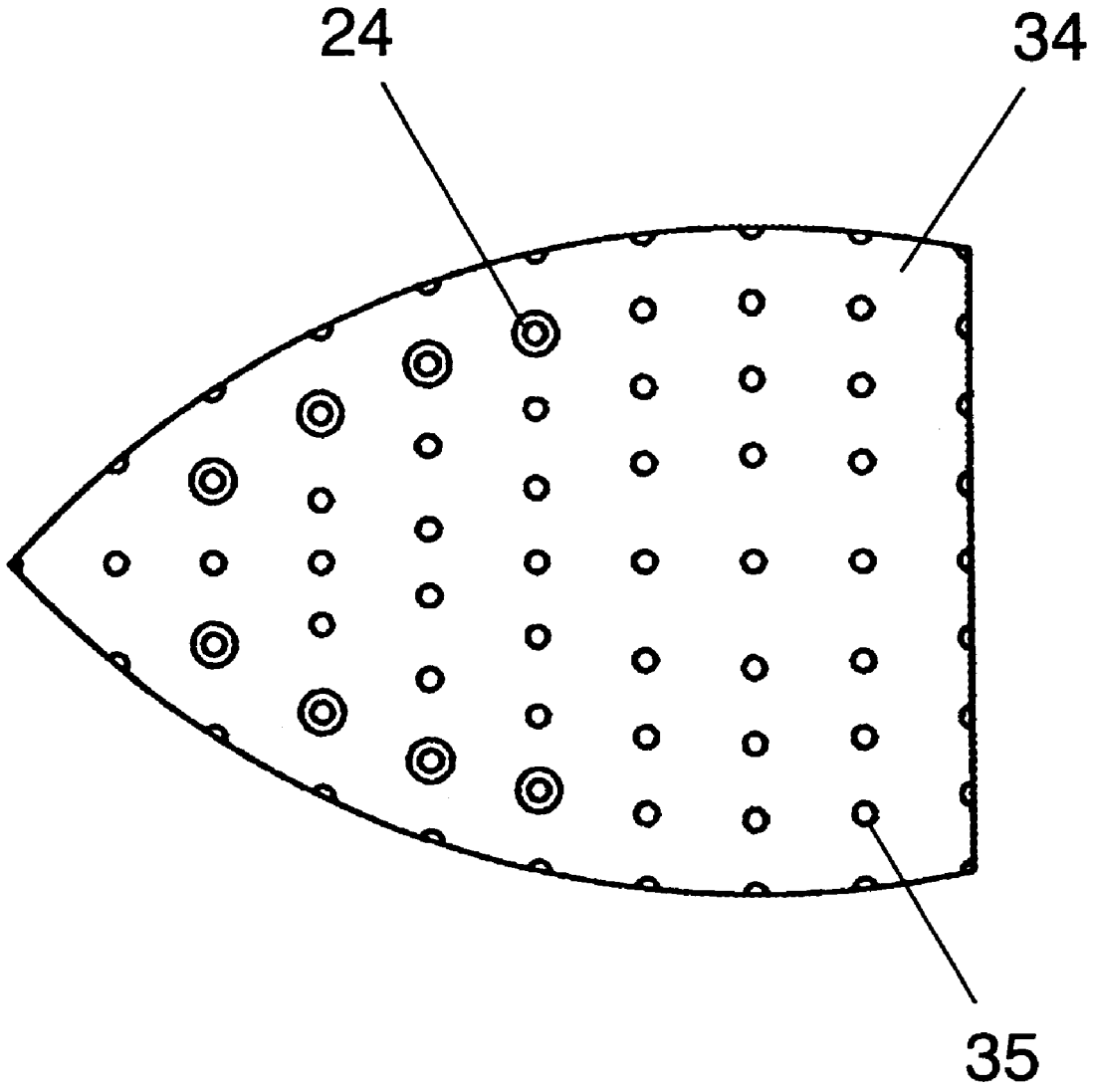
FIG. 13 is a bottom view of a first base in accordance with the fourth exemplary embodiment of the present invention.

In FIG. 12, a first base 34, including vaporizing chamber 2 and heater 4, is made of aluminum. FIG. 13 is a bottom view of first base 34 viewed from below. A plurality of cylindrical ribs 35 protrude from a lower face of first base 34 and directly contact with second base 23. Thermal resistance layer 36 comprises an air layer enclosed by the lower face of first base 34 and an upper face of second base 23, and the cylindrical ribs 35.

An operation of the iron having the structure discussed above is described. In the same manner as with the second embodiment, the first base 34 can maintain a higher temperature than second base 23, so that an amount of accumulated heat can be increased. Since first base 34 maintains contact with second base 23 through plural points, this structure can transfer the heat quickly and in a uniform manner to second base 23 when second base 23 incurs temperature fall. In other words, this fourth embodiment effects quick temperature recovery, and can provide an iron which is easy to operate.

In this fourth embodiment, cylindrical ribs are used as an example; however, ribs of any protruding shapes can produce the same effect.

Fifth exemplary embodiment

The fifth exemplary embodiment of the present invention is described with reference to FIG. 14. Basically the same structure as the second embodiment is used, and therefore, the same reference numbers are used and the descriptions of the same elements are omitted.

Figure 14:
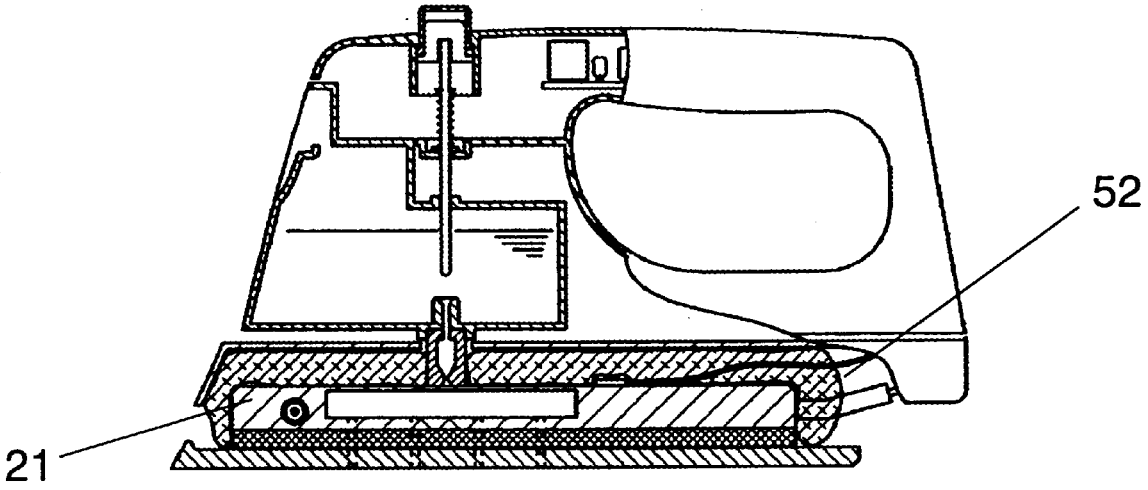
FIG. 14 is a side cross section of part of an iron in accordance with a fifth exemplary embodiment of the present invention.

In FIG. 14, a heat insulating material 52 covering first base 21 is made of foamed silicone resin. First base 21 thus functions as a heat accumulator. This embodiment advantageously prevents first base 21 from losing heat, and increases the effect of heat accumulation of the iron.

Sixth exemplary embodiment

Figure 15:
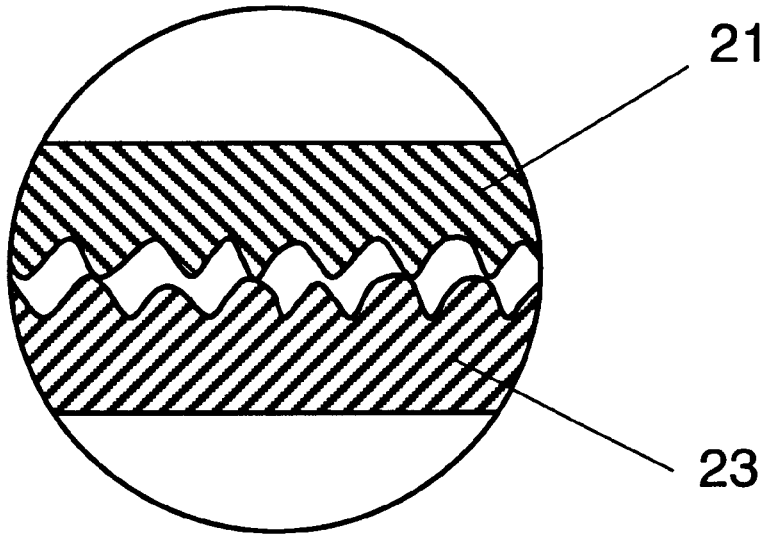
FIG. 15 is an enlarged sectional view of a contact face between first and second bases in accordance with a sixth exemplary embodiment.

In this sixth embodiment, silicone rubber 22 is removed from the first exemplary embodiment, and first base 21 is made of aluminum or aluminum alloy in this sixth. A contact face with second base 23 of first base 21 is roughened by a sandblast method (peaks and valleys are formed on the contact face) as shown in FIG. 15. The counterpart of second base 23 is also roughened by the sandblast method. As a result, a thermal resistance layer comprising an air layer and peaks of the roughened faces is formed between first base 21 and second base 23.

Figure 16:
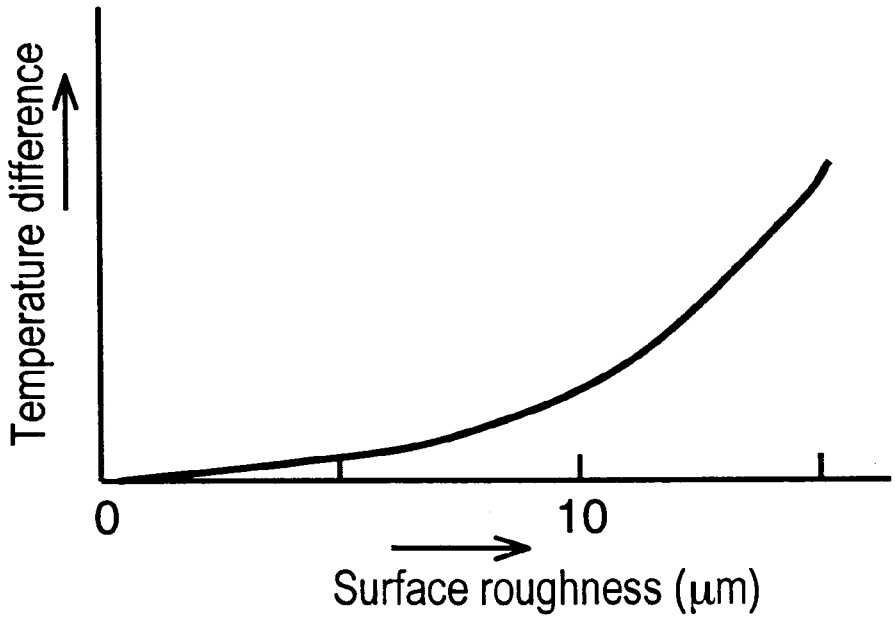
FIG. 16 illustrates a relation of surface roughness of the contact face between the first and second bases vs. temperature difference therebetween.
Figure 17:
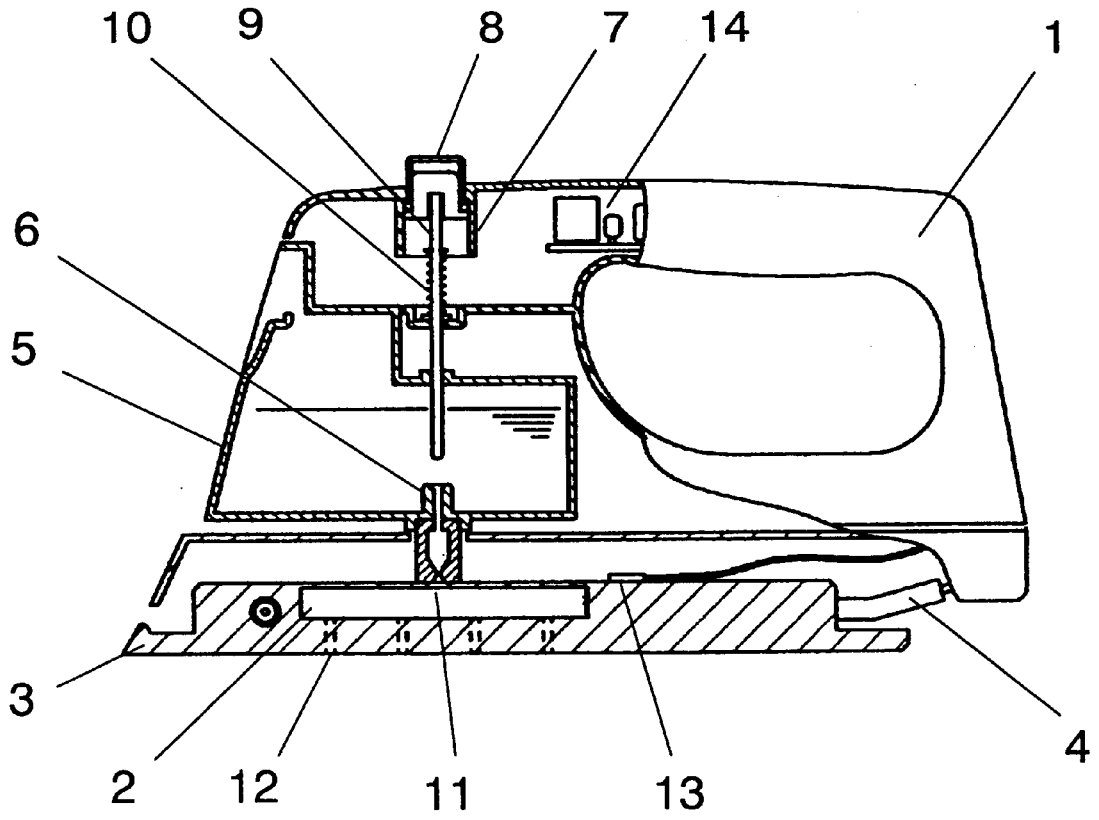
FIG. 17 is a side cross section of part of the conventional iron.
Figure 18:
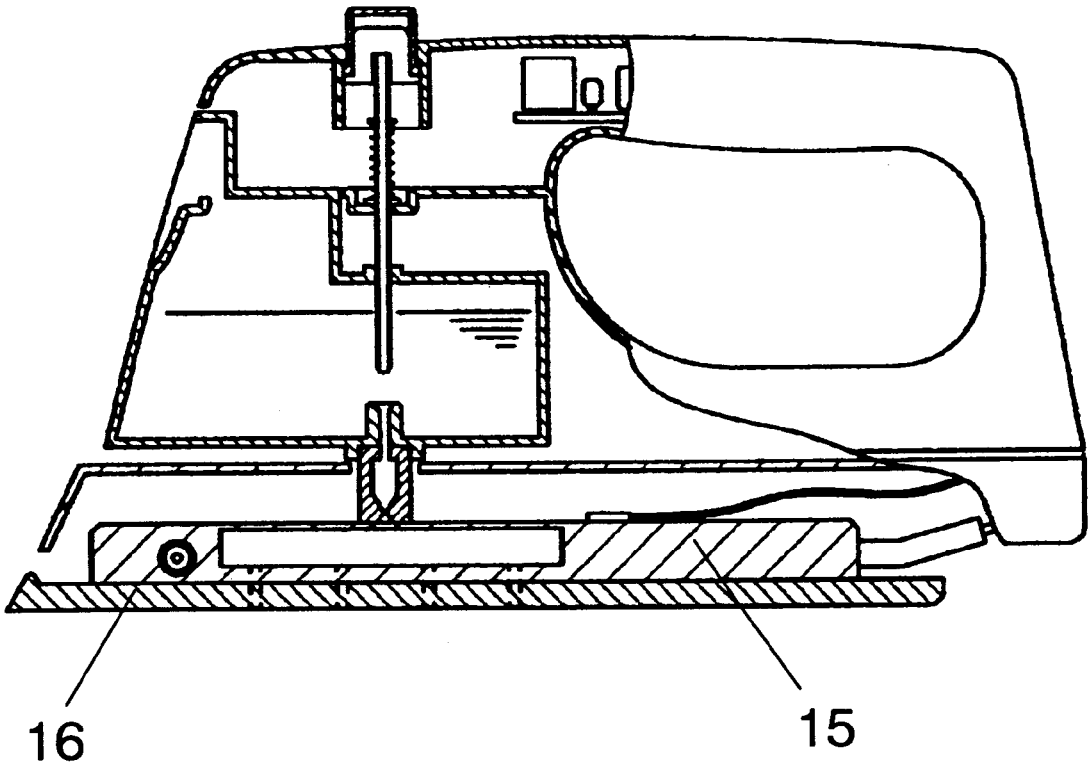
FIG. 18 is a side cross section of part of another conventional iron.

When the roughness of at least one of the contact faces of base 21 and base 23 is varied, heat conductivity varies as shown in FIG. 16. The roughness of at least one contact face of first base 21 or second base 23 is plotted on the X-axis, and the temperature differences therebetween are plotted on the Y-axis. When the roughness Rz (average of ten points) grows to not less than 10 $\mu$m, the temperature difference sharply increases.

Accordingly, the roughness of at least one of the contact faces of first base 21 or second base 23 is set at not less than 10 $\mu$m so that first base 21 can maintain a higher temperature and thus an accumulated heat amount can be increased. As a result, the iron of the present invention can smooth wrinkles of a bulk of clothes because the soleplate incurs only a little temperature fall. Further, this iron is free from being powered during ironing. The iron thus can make the ironing job easier and is easy to handle.

When steam is produced, the roughness of at least one of the contact faces of first base 21 or second base 23 is set at not less than 10 $\mu$m, thereby extending a steam spraying period, which contributes to smoothing wrinkles of a bulk of clothes.

In this embodiment, the sandblast method is employed to roughen both of the contact surfaces of first base 21 and second base 23; however, as FIG. 16 illustrates, either one of contact faces can be roughened. Other methods than sandblasting, such as a method of forming peaks and valleys by molding, a mechanical processing method including cutting or applying pressure, or a chemical etching method, can be employed for roughening the contact face.

Seventh exemplary embodiment

In this seventh embodiment, a second base 23 comprising at least one of ceramic, iron, or stainless steel is used instead of the aluminum used in the sixth embodiment. The heat-conductivities of these materials are lower than that of aluminum. A contact face of base 23 with first base 21 is roughened by a sandblast method so that an air layer is formed when both the bases are contacted. As a result, a thermal resistance layer comprising peaks of the roughened face and the air layer are formed between first base 21 and second base 23.

Since second base 23 comprises at least one of ceramic, iron metal or stainless steel, of which heat conductivities are lower than that of aluminum, the heat of first base 21 does not transfer to base 23 so well. This produces a temperature difference between first base 21 and second base 23. Therefore, first base 21 can maintain a higher temperature than second base 23 due to that difference.

Further, a thermal resistance layer comprising an air layer and peaks of the roughened faces is formed between first base 21 and second base 23, which expands the temperature difference and increases an accumulated heat amount in the iron.

Eighth exemplary embodiment

In the sixth embodiment, second base 23 is made of aluminum and its contact face with first base 21 is roughened by a sandblast method. In this eighth embodiment, an air layer is disposed between the first and second bases, and further, second base 23 is covered by a film including fluorocarbon resin, which is a low heat conduction material, on its entire surface. A temperature difference between the two bases becomes greater than that in the sixth embodiment, which further increases an accumulated heat amount in the iron.

The film including the fluorocarbon resin effects better sliding of the iron during ironing. This eighth embodiment produces these two effects, so that an iron of better performance can be realized.

The aluminum-made second base 23 is used in this embodiment; however, it may be made of at least one of ceramic, iron metal or stainlesssteel, the same materials used in the seventh embodiment. In this case, a contact face with first base 21 is not necessarily roughened.

As discussed in the previous exemplary embodiments, the iron of the present invention increases its accumulated heat amount without increasing its weight. As a result, the iron of the present invention can smooth wrinkles of a bulk of clothes at one time, also can extend a spraying period of steam, and does not require powering of the iron to heat the base during ironing. As a result, the iron of the present invention makes the ironing job easier.

What is claimed is:

1. An iron comprising:

a first base to be directly heated;

a second base having a soleplate; and a thermal resistance layer disposed between said first base and said second base to completely cover an entire area between said first base and said second base, wherein said thermal resistance layer continuously restrains heat conductivity between said first base and said second base.

2. The iron as defined in claim 1 wherein said thermal resistance layer has a greater heat resistance than that of said first base.

3. The iron as defined in claim 1 wherein said first base has a greater mass than said second base.

4. The iron as defined in claim 2 wherein said thermal resistance layer comprises at least one of metal, resin, filling agent, mineral, heat insulating material, and air.

5. The iron as defined in claim 2 wherein at least part of one of said first base and said second base is covered with heat insulating material.

6. The iron as defined in claim 3 wherein at least part of one of said first base and said second base is covered with heat insulating material.

7. The iron as defined in claim 4 wherein at least part of one of said first base and said second base is covered with heat insulating material.

8. The iron as defined in claim 2 wherein a vaporizing chamber is disposed in said first base.

9. The iron as defined in claim 3 wherein a vaporizing chamber is disposed in said first base.

10. The iron as defined in claim 4 wherein a vaporizing chamber is disposed in said first base.

11. An iron as defined in claim 2, wherein said thermal resistance layer comprises an extended section and air, said extended section being disposed on at least one of said first base and said second base and projecting toward and contacting the other of said first base and said second base.

12. The iron as defined in claim 11 wherein said at least one extended section comprises one of the following elements:

(a) an outer circumferential rib formed along a circumference of said one of said first base and said second base;

(b) a line-rib formed on a surface of said one of said first base and said second base; and (c) a protrusion formed on a surface of at least one of said first base and said second base.

13. The iron as defined in claim 11 wherein said first base has a greater mass than said second base.

14. The iron as defined in claim 12 wherein said first base has a greater mass than said second base.

15. The iron as defined in claim 11 wherein at least part of one of said first base and said second base is covered with heat insulating material.

16. The iron as defined in claim 12 wherein at least part of one of said first base and said second base is covered with heat insulating material.

17. The iron as defined in claim 13 wherein at least part of one of said first base and said second base is covered with heat insulating material.

18. The iron as defined in claim 11 wherein a vaporizing chamber is disposed in said first base.

19. The iron as defined in claim 12 wherein a vaporizing chamber is disposed in said first base.

20. The iron as defined in claim 13 wherein a vaporizing chamber is disposed in said first base.

21. An iron as defined in claim 2, wherein said thermal resistance layer comprises a roughened face and air, said roughened face being formed on at least one of a first contacting face of said first base and a second contacting face of said second base and contacting the other of said first base and said second base.

22. The iron as defined in claim 21 wherein said at least one of said first and second contacting faces is roughened at not less than 10 $\mu$m roughness.

23. The iron as defined in claim 21 wherein said at least one of said first and second contacting faces is roughened by at least one of a sandblast method, a mechanical processing method, and a chemical etching method.

24. The iron as defined in claim 21 wherein a vaporizing chamber is disposed in said first base.

25. The iron as defined in claim 21 wherein at least part of said second base is covered by a film including fluorocarbon resin.

26. The iron as defined in claim 21 wherein at least part of one of said first base and said second base is covered with heat insulating material.

27. An iron as defined in claim 1, wherein said second base has a smaller heat conductivity rate than said first base.

28. The iron as defined in claim 27 wherein said second base comprises at least one of ceramic, iron and stainless steel.

29. The iron as defined in claim 27 wherein a vaporizing chamber is disposed in said first base.

30. The iron as defined in claim 27 wherein at least part of said second base is covered with a film including fluorocarbon resin.

31. The iron as defined in claim 27 wherein at least part of one of said first base and said second base is covered with heat insulating material.

* * * * *